US008465299B2

(12) United States Patent
Ho

(10) Patent No.: US 8,465,299 B2
(45) Date of Patent: Jun. 18, 2013

(54) RECEPTACLE CONNECTOR WITH SUPPORT STRUCTURE

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 43 days.

(21) Appl. No.: 13/186,576

(22) Filed: Jul. 20, 2011

(65) Prior Publication Data

US 2012/0021651 A1 Jan. 26, 2012

(30) Foreign Application Priority Data

Jul. 20, 2010 (TW) ..... 99213825 U

(51) Int. Cl.
*H01R 12/00* (2006.01)

(52) U.S. Cl.
USPC ..... 439/79; 439/607.05

(58) Field of Classification Search
USPC ..... 439/79, 607.05, 607.11, 607.35–607.38, 439/358, 660, 676
See application file for complete search history.

(56) References Cited

U.S. PATENT DOCUMENTS

| | | | | |
|---|---|---|---|---|
| 6,827,610 | B2 * | 12/2004 | Lin | 439/607.37 |
| 7,217,159 | B2 * | 5/2007 | Chung | 439/607.01 |
| 7,517,253 | B1 * | 4/2009 | Chiang | 439/660 |
| 7,862,346 | B1 * | 1/2011 | Wan et al. | 439/79 |
| 7,887,370 | B2 * | 2/2011 | Chen et al. | 439/607.35 |
| 8,079,879 | B2 * | 12/2011 | Chiang | 439/660 |
| 8,133,078 | B2 * | 3/2012 | Lin et al. | 439/660 |
| 2009/0111330 | A1 | 4/2009 | Lin et al. | |

* cited by examiner

*Primary Examiner* — Thanh Tam Le
(74) *Attorney, Agent, or Firm* — Stephen L. Sheldon

(57) ABSTRACT

An electrical connector comprises a housing, a plurality of first, second and third terminals and a shield fitting over an exterior of the housing. The housing comprises a base and a tongue with a front end; the base is provided with a base wall and an assembly slot that receives the tongue. The tongue can include a U-shaped flange that mates to the assembly slot and extends convexly forward from the base wall to support the posterior of the tongue. Each first terminal is provided with an elastic contact which is exposed on the top surface. Each second terminal is provided with a second contact exposed on the top surface and closer to the front end of the tongue than the elastic contacts. Each third terminal is provided with a third contact that is exposed on the bottom surface.

11 Claims, 9 Drawing Sheets

RECEPTACLE CONNECTOR WITH SUPPORT STRUCTURE

RELATED APPLICATIONS

This application claims priority to Taiwan Application No. 99213825, filed Jul. 20, 2010, which is incorporated herein by reference in its entirety.

TECHNICAL FIELD

The present invention relates to an electrical connector and more particularly to a connector suitable for use with different protocols.

BACKGROUND ART

Composite electrical connectors, which are intended to meet the usage requirements of multi-functionality and economical volume and are able to conform to a variety of signal transmission standards, have become the trend in the development of electrical connectors. In particular, because signal transmission standards are constantly being updated, composite electrical connectors that can simultaneously handle old and new transmission standards during the transition period from old to new transmission standards are able to increase ease of use.

The signal transmission formats most commonly used at present are USB 2.0, USB 3.0 (USB being an abbreviation for "universal serial bus") and ESATA (which is an abbreviation for "external serial advanced technology attachment"), and for that reason composite socket electrical connectors have been developed into which USB 2.0, USB 3.0 and ESATA plug connectors can be separately plugged, such as that disclosed by Taiwanese Utility Model Publication No. M357748 (corresponding Chinese Patent Application No. 200810173163.4; corresponding U.S. Patent Publication No. US2009111330A1). The structure disclosed in Patent No. M357748 comprises three types of terminals, wherein the first type of terminal is a terminal for an ESATA connector, the second type of terminal is a terminal for a standard USB 2.0 connector, and the third type of terminal acts with the second type of terminal to form together a terminal for a USB 3.0 connector, the third type of terminal being integrated with the tongue and buried within the tongue, the first type of terminal being installed on the upper surface of the tongue, and the second type of terminal being installed on the lower surface of the tongue. Referring to FIG. 8 of the above specification and related description, the point of intersection between the upper surface of the tongue and rear wall integrally form a thickened part, while the first terminal slot fitted onto the tongue upper surface to house the first type of terminal also penetrates the thickened part, and the increased strength provided by the thickened part facilitates the securing of the fixed part of the terminal. However, the structural strength of the split assembly tongue in itself is comparatively weak due to the comparatively thin thickness thereof; and cannot easily bear insertion/removal force or rotational torque, or is liable in conditions of non-normal insertion/removal to result in a state where the tongue is loosened or fractured and so on. The thickened part increases the thickness of the tongue in order to strengthen the security of the corresponding terminal fixed part but because the thickened part is perforated and segmented by the plurality of first terminal slots, provides little contribution towards strengthening the entire body of the tongue. In addition, in the first type of terminal, a long and straight board-shaped contact part extends forwards from the fixed part, and this contact part of the first type of terminal is simply placed inside the first terminal slot of the tongue surface, thus it cannot be secured in place and tendency to be deformed or buckled. Consequentially, certain individuals would appreciate an improved connector.

SUMMARY OF THE INVENTION

An electrical connector comprises a housing, a plurality of first terminals, a plurality of second terminals, a plurality of third terminals, and a shield fitting over the exterior of the housing. The housing comprises a base and a tongue; the base is provided with a base wall, an assembly slot, to which the tongue snaps in, running through the base wall from back to front, and a U-shaped flange mated to the assembly slot which extends convexly forward from the base wall to frame and support a posterior of the tongue. The tongue is provided with a top surface and a bottom surface which is located on the opposite side of the top surface and is approximate the flange. The first terminals are fixed to the housing, and the first terminals each have an elastic contact exposed on the top surface of the tongue. The second terminals are fixed to the housing, and the second terminals each have a second contact exposed on top of the body of the tongue and in closer proximity to the front of the tongue than the elastic contacts of the first terminals. The third terminals are fixed to the housing, and the third terminals are each provided with a third contact exposed on the bottom of the body of the tongue; the posterior of the third contact is wedged between the bottom surface of the tongue and the flange.

BRIEF DESCRIPTION OF THE DRAWINGS

The disclosure is illustrated by way of example and not limited in the accompanying figures in which like reference numerals indicate similar elements and in which.

DETAILED DESCRIPTION OF THE PREFERRED EMBODIMENTS

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated by the disclosure provided herein, it is possible in certain embodiments to provide an electrical connector wherein the strength of the split tongue can be reinforced. In addition, in certain embodiment the board-shaped contact part of a fixed terminal may be strengthened. The support can be provided for the tongue by a U-shaped flange, which extends convexly from the front of the base wall to frame the posterior of the tongue. This can reinforce the support strength of the split tongue and increase the structural strength thereof. By having the posterior of the third contact wedged between the bottom surface of the tongue and the flange, the third contact can be restrained, securing the same into place and preventing deformation or buckling of the third contact.

Figure 1:
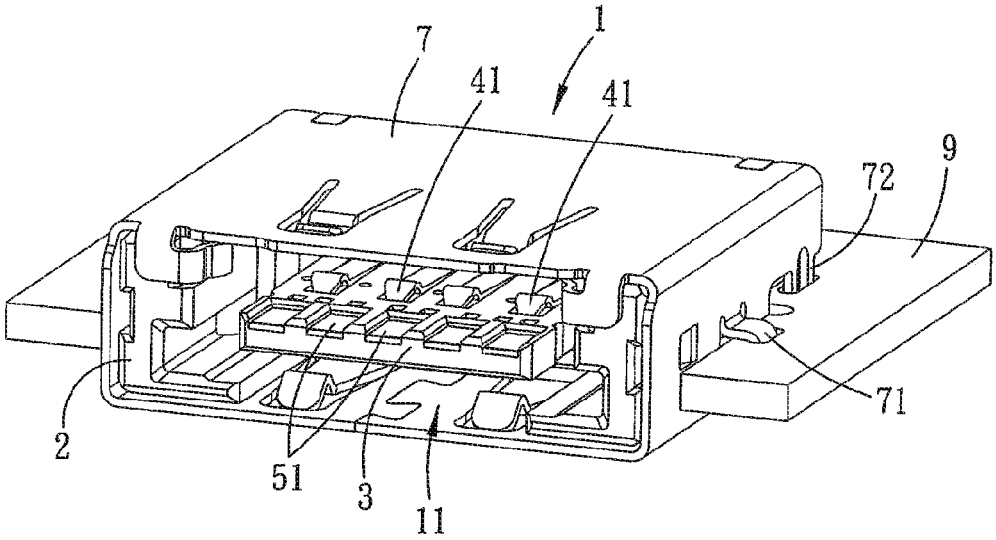
FIG. 1 is a perspective view of an embodiment of the electrical connector a circuit board.
Figure 2:
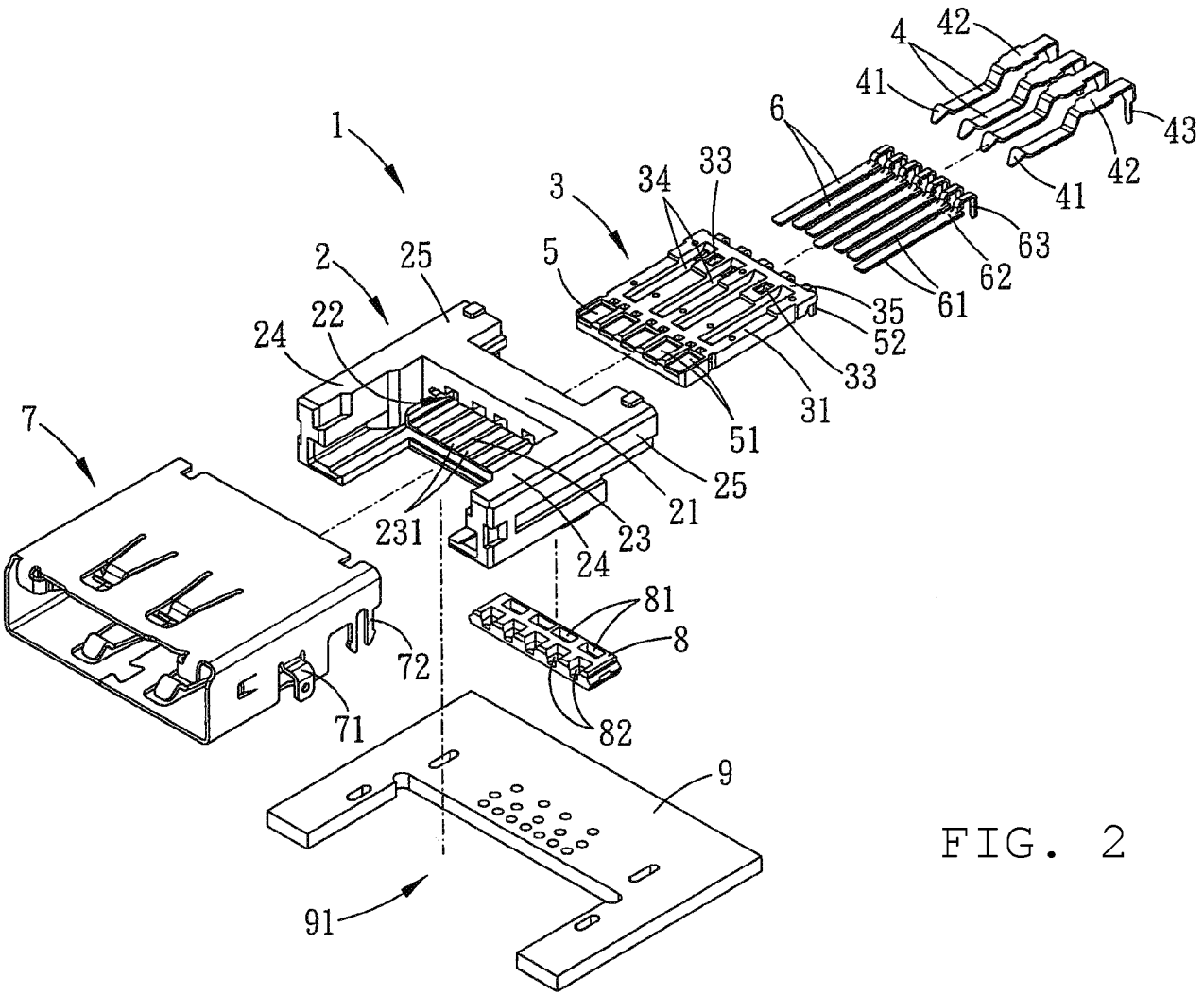
FIG. 2 is an exploded view of FIG. 1.
Figure 3:
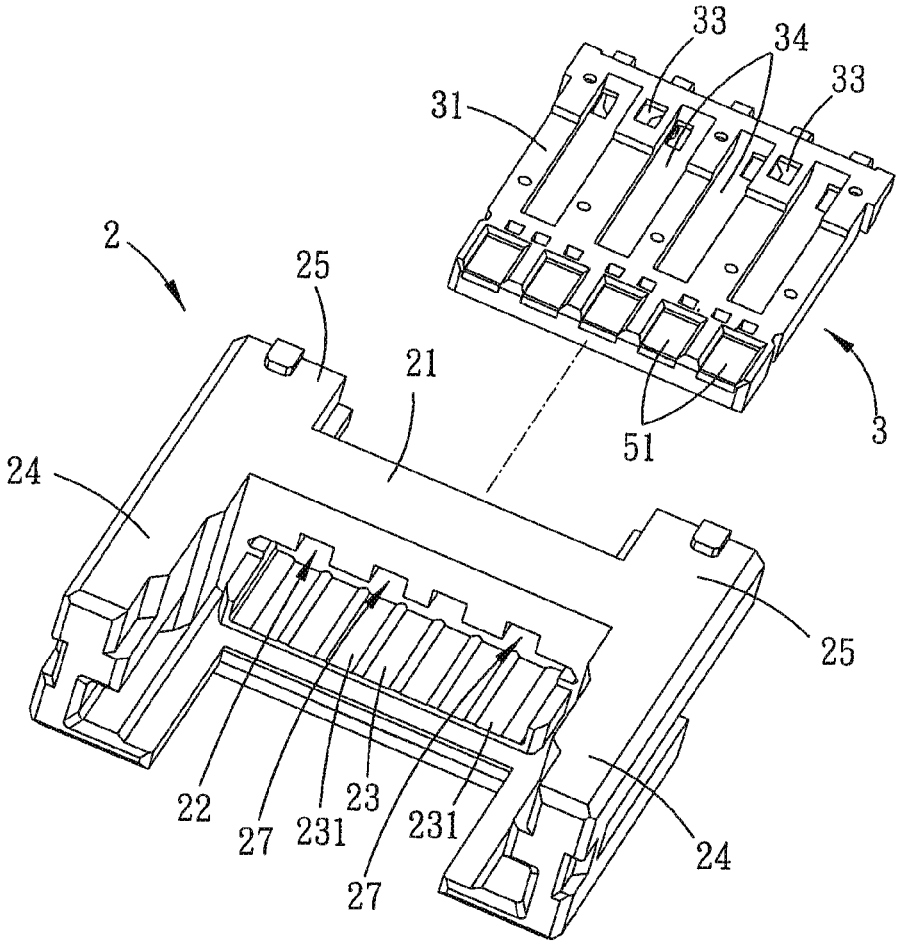
FIG. 3 is a perspective exploded view illustrating the structure of the base and tongue of the first preferred embodiment.
Figure 4:
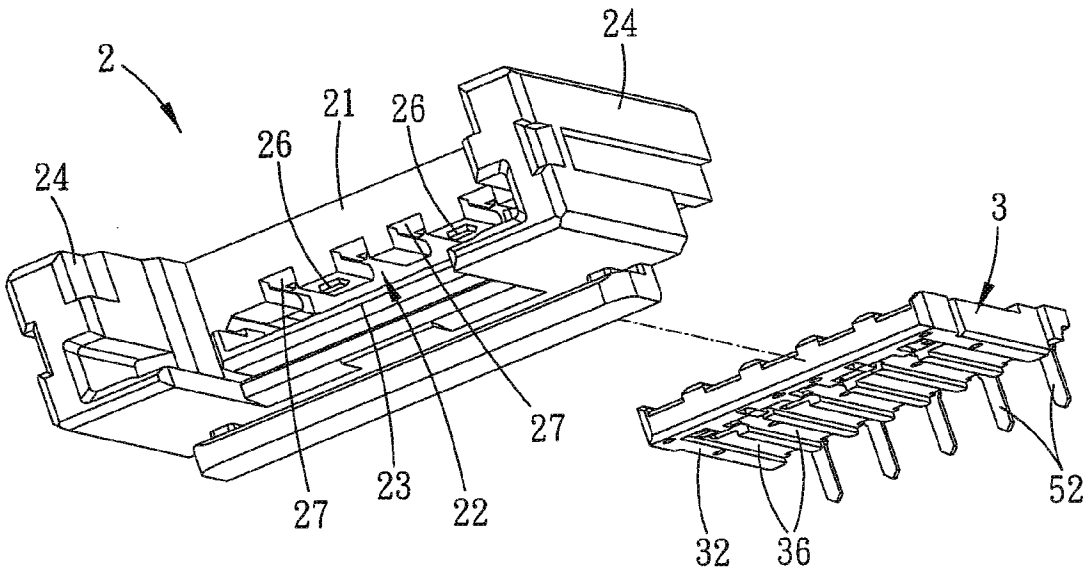
FIG. 4 is another perspective view of the embodiment depicted in FIG. 3.
Figure 5:
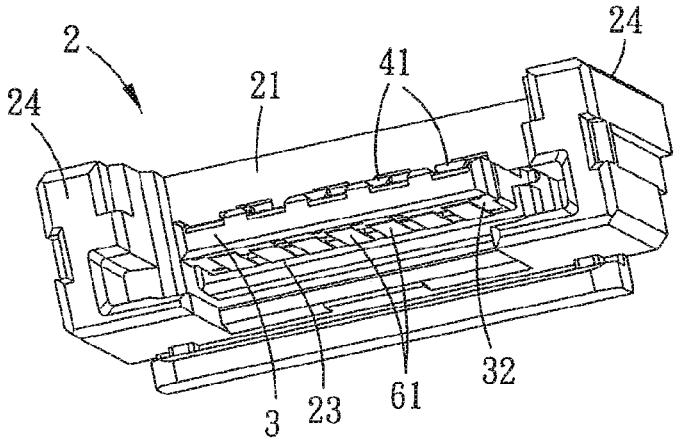
FIG. 5 is a simplified perspective view of the embodiment depicted in FIG. 1.

As seen from FIG. 1 and FIG. 2, an embodiment of the electrical connector is suitable for use with a circuit board 9 which is provided with a notch 91, whereby electrical connector 1 is partially positioned beneath the board through notch 91. Electrical connector 1 comprises a housing, a plurality of first terminals 4, a plurality of second terminals 5, a plurality of third terminals 6, a shield 7 and terminal positioning board 8.

Figure 6:
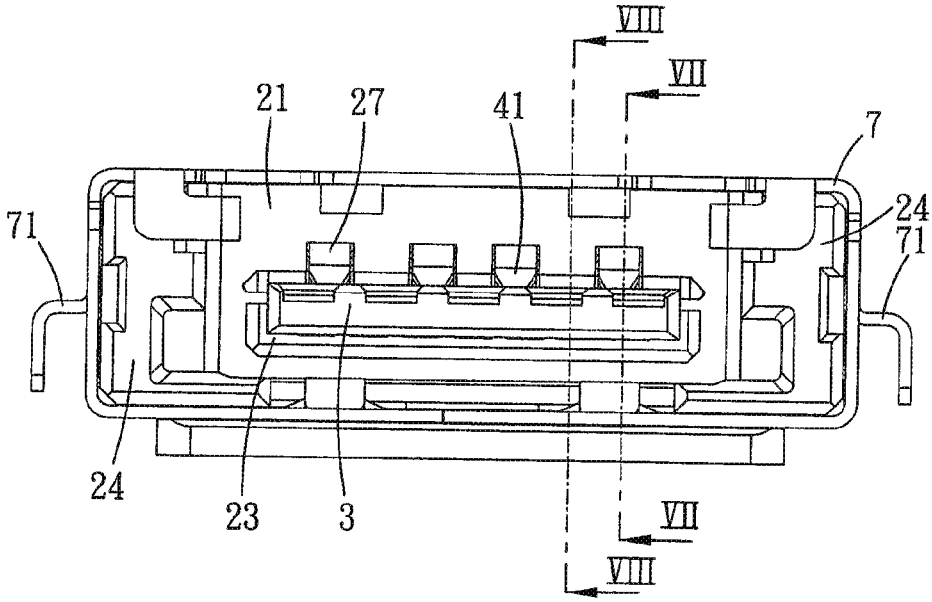
FIG. 6 is a front view of FIG. 1.
Figure 7:
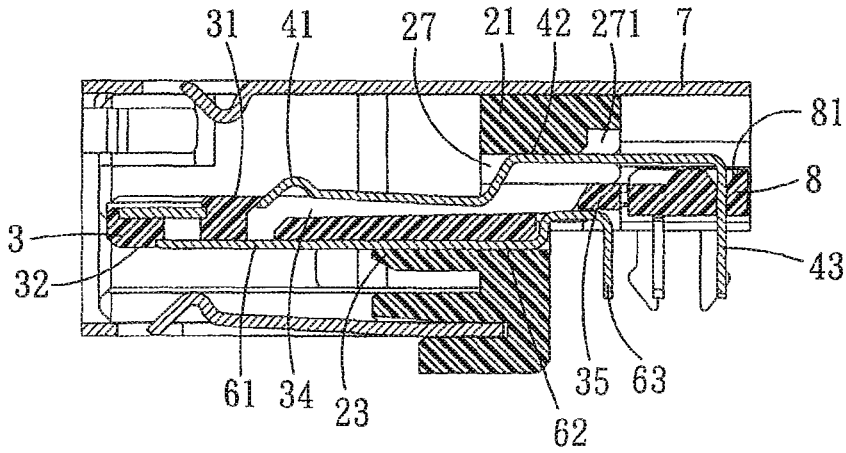
FIG. 7 is a cross-section view taken from along the straight line VII-VII in FIG. 6.
Figure 8:
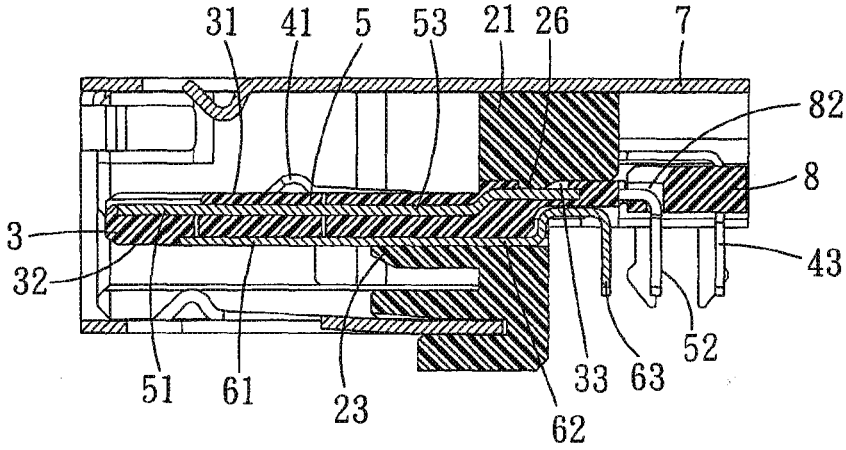
FIG. 8 is a cross-section view taken from along the straight line VIII-VIII in FIG. 6.
Figure 9:
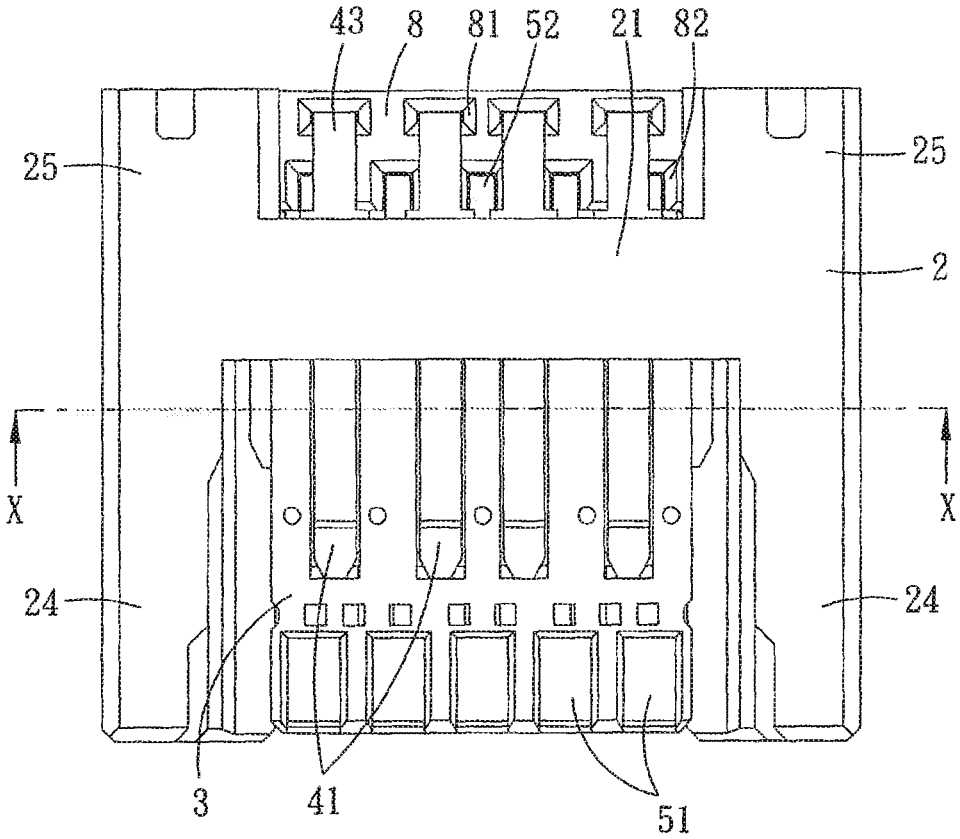
FIG. 9 is a plan view of the embodiment depicted in FIG. 5.
Figure 10:
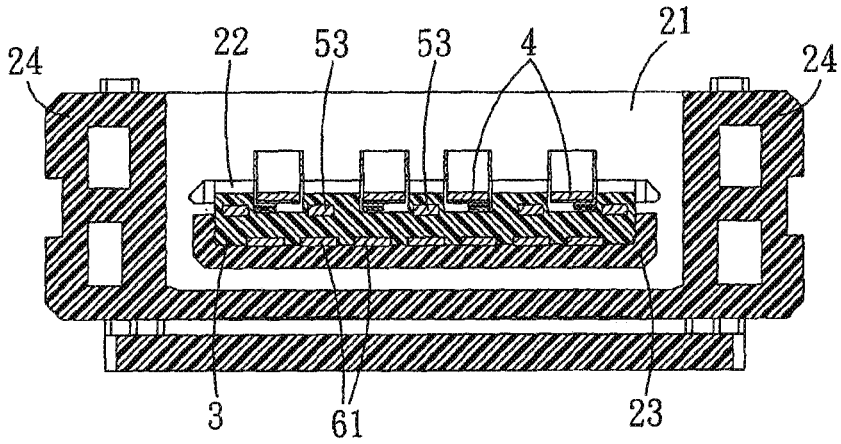
FIG. 10 is a cross-section view taken from along the straight line X-X in FIG. 9.
Figure 11:
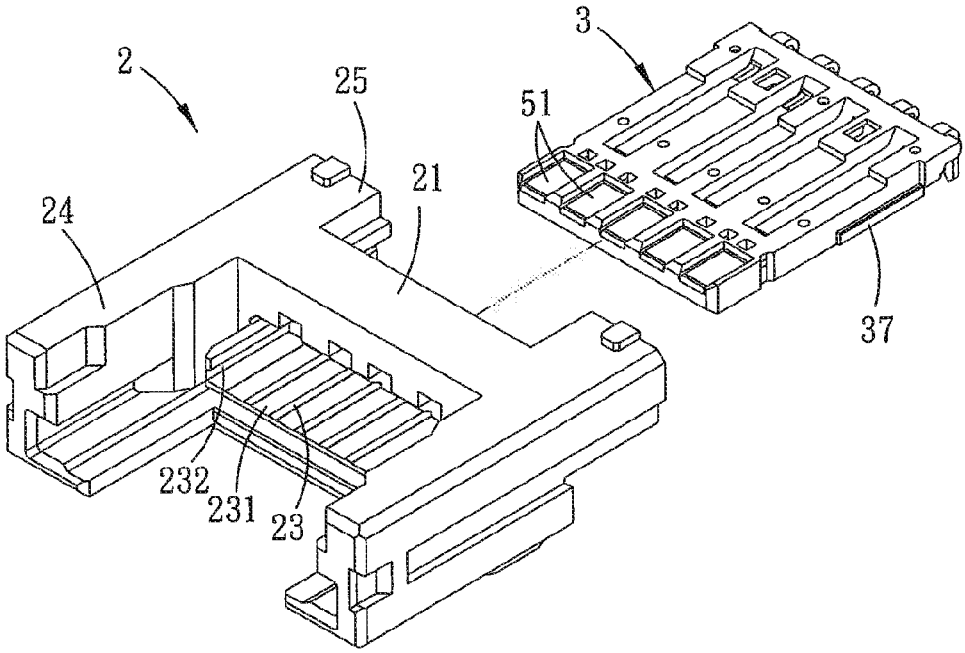
FIG. 11 is a perspective exploded view of another embodiment of an electrical connector.
Figure 12:
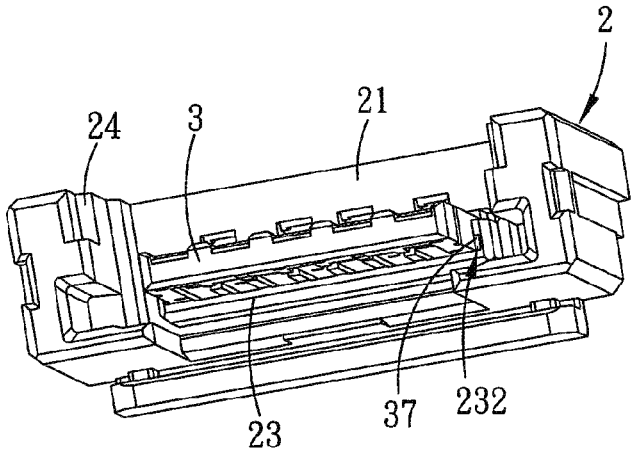
FIG. 12 is a perspective view of the embodiment depicted in FIG. 11 with the components assembled.
Figure 13:
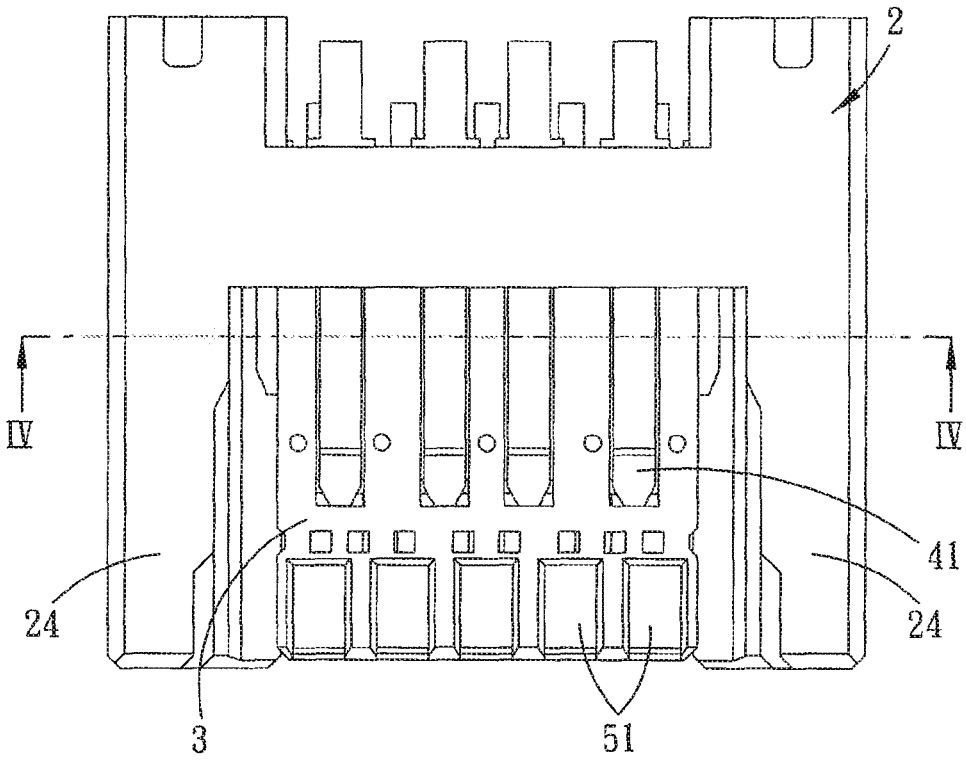
FIG. 13 is a plan view of the embodiment depicted in FIG. 11.
Figure 14:
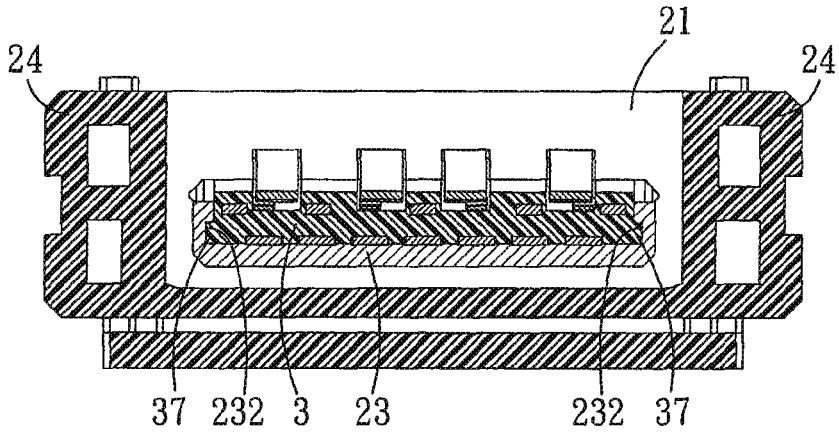
FIG. 14 is a cross-section view taken from along the line IV-IV in FIG. 13.

As seen in FIGS. 2 to 5, the housing comprises a base 2 and a tongue 3. The base 2 is provided with an upright base wall 21, an assembly slot 22, to which the mated tongue 3 snaps in, running through base wall 21 from back to front, and a flange 23, which may be U-shaped, mated to the assembly slot 22 and extending forward from the base wall 21 to frame and support the posterior of the tongue 3 (see also FIGS. 9 and 10), potentially in a convex manner. The base 2 is further provided with two side walls 24 which are integrally connected to the two forward extensions of base wall 21 and positioned on both the left and right sides of tongue 3, and two rear cantilevers 25 which are each integrally connected to both sides of base wall 21 and extend opposite to the upper portion of each side wall 24 toward the rear, wherein the bottom of the two rear cantilevers 25 prop up the surface of the circuit board 9. The tongue 3 is provided with a top surface 31 and a bottom surface 32 located on the opposite side of the top surface 31 and the flange 23. The posterior of the top surface 31 of the tongue 3 as well as locations in the base wall 21 of the base 2 positioned within the assembly slot 22 are provided with a plurality of clip slots 33 and clip blocks 26 which are mated to one another (see also FIGS. 6 and 8); in the present embodiment, the clip slots 33 are located on the tongue 3 and the clip blocks 26 are located on base 2, but the positions of the clip slots 33 and the clip blocks 26 can also be interchangeable. The tongue 3 snaps into the assembly slot 22, and the mutual snapping of the clip slots 33 and the clip blocks 26 strengthens the binding between the tongue 3 and the base wall 21, as well as utilizing the bottom surface 32 and sides of the flange 23 which frames the posterior of the tongue 3 (the part joining the front of base wall 21) to provide support for the tongue 3, and thus reinforcing the support strength of the tongue 3 and increasing the structural strength thereof to boost the stability of the tongue 3/base wall 21 combined structure.

As seen in FIGS. 2, 3, 4, 6 and 7, the tongue 3 is further provided with a plurality of first terminal slots 34 which are depressed at intervals downward from the top surface 31; the rear ends of the terminal slots 34 are defined by a boss 35. The posterior of the tongue 3 is made by providing the boss 35 with a block shape that is horizontally integrally connected and thicker, thus the strength of the tongue 3 may be increased. The base 2 further possesses a plurality of first terminal passageways 27 fitted on the base wall 21 and corresponding to the terminal slots 34, and each location where the first terminal passageways 27 correspond to the boss 35 is provided with a yield notch 271. The tongue 3 is further provided with a plurality of third terminal slots 36 fitted on the bottom surface 32 and respectively corresponding to each third terminal 6, and the flange 23 is fitted with a plurality of third terminal passageways 231 respectively corresponding to each third terminal slot 36.

As seen in FIGS. 1, 2, 6 and 7, each of the first terminals 4 is fixed to the housing and is provided with an elastic contact 41 positioned to correspond to each terminal slot 34, a first fixed part 42 extending back from elastic contact 41 and fixed to the corresponding first terminal passageway 27, and a first connection-guiding part 43 extending downward from first fixed part 42. The assembly thereof is to place the same from the rear side of the base 2 forward into the first terminal passageway 27 and enable the front end of the elastic contact 41 to pass over the boss 35 of the rear end of terminal slot 34 by means of the yield notch 271 of first terminal passageway 27, thus easily entering terminal slot 34 so as to complete the assembly.

As seen in FIGS. 2, 6, 8, 9 and 10, each second terminal 5 is fixed to the housing, is buried by means of in-mold insert-molding into tongue 3, and is provided with second contact 51 which is exposed on the top surface of body 31 of tongue 3 and is in closer proximity to the front end of tongue 3 than elastic contacts 41 of terminals 4, second connection-guiding part 52 extending convexly out from tongue 3 and extending downward, and second extension 53 connected to second contact 51 and second connection-guiding part 52; second extension 53 is buried into tongue 3.

As seen in FIGS. 2, 5, 7 and 10, each third terminal 6 is fixed to the housing and is provided with a third contact 61 exposed on the bottom surface 32 of tongue 3 and positioned in the third terminal slot 36, a third fixed part 62 extending toward the rear from the third contact 61 and fixed into the third terminal slot 36 and corresponding third terminal passageway 231, and a third contact 63 extending in an inverted U curve from third fixed part 62. The third contact 61 assumes an elongated board shape, with the posterior wedged between the bottom surface 32 of the tongue 3 and the flange 23, thus being able to restrain the third contact 61 and secure the same in place, preventing the deformation or buckling of the third contact 61. As can be appreciated, the first terminals 4 are a group of terminals for transmitting signals that conform to the USB 2.0 (USB being an abbreviation for "universal serial bus") signal transmission standard, and the first terminals 4 act with second terminals 5 as a group of terminals for transmitting signals that conform to the USB 3.0 signal transmission standard, while third terminals 6 are a group of terminals for transmitting signals that conform to the ESATA (which is an abbreviation for "external serial advanced technology attachment") signal transmission standard.

As seen in FIGS. 1 and 2, the shield 7 is fitted over the exterior of the housing and, together with base 2, defines plug slot 11, and is provided with two fixed pieces 71 and two dowel pins 72 which are used to fix the same to circuit board 9. As seen in FIGS. 2, 7, 8 and 9, the terminal positioning board 8 is provided with two rows of perforations 81 and 82, which respectively penetrate first connection-guiding parts 43 of the first terminals 4 and second connection-guiding parts 52 of the second terminals 5 so as to position the first connection-guiding parts 43 and the second connection-guiding parts 52.

In the present embodiment, one mode for integrally assembling an electrical connector 1 is to first place the tongue 3 integrally molded with the second terminals 5 from behind base 2 into the assembly slot 22 and fixedly snap the same thereinto, at which point the second connection-guiding parts 52 of the second terminals 5 are bent at the ends and are placed into the rear of third terminal passageways 231 and the third terminal slots 36 from the rear side of the base 2 up until the third terminals 6. Then the second connection-guiding parts 52 are bent; thereafter first terminals 4 are installed, where the mode for installing first terminals 4 has already been described above, and therefore shall not be described again. Next, shield 7 is fitted over base 2 from the front side of base 2 towards the rear, and then terminal positioning board 8 is fixedly snapped into base 2. As shown in FIG. 1, the completely assembled electrical connector 1 is installed into circuit board 9 to form a sink-plate type wherein a portion is positioned above the board and a portion is positioned below the board.

As seen in FIGS. 11 to 14, a second embodiment similar to the first embodiment, except the tongue 3 is further provided with two protruding ribs 37 located respectively on the left and right sides, and that the flange 23 is fitted with two clip grooves 232 which receive the corresponding protruding ribs 37, so that the interlocking of the protruding ribs 37 with the clip grooves 232 is able to reinforce the security of the tongue 3, thus further reinforcing the support strength of the split tongue 3 and increasing the structural strength thereof.

As can be appreciated, therefore, the electrical connector 1, because the bottom surface 32 and sides of the U-shaped flange 23 extend convexly forward from the front of side wall 21 and frame the posterior of tongue 3 (the part joining the front of base wall 21), support is provided for the tongue 3, thus reinforcing the support strength and structural strength of split tongue 3 so as to boost the stability of the tongue 3-base wall 21 combined structure; also, because the posterior of the third contact 61 is wedged between the bottom surface 32 of the tongue 3 and the flange 23, this enables the restraining of the third contact 61 and secures the same in place, preventing the deformation or buckling of the third contact 61, thereby reliably achieving the objectives of the present invention.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. An electrical connector, comprising:

a housing including a base and a tongue, the base including a base wall, an assembly slot running from front to back through the base wall, wherein the tongue is positioned in the assembly slot, a flange formed adjacent to the assembly slot, the flange extending convexly forward from the base wall to support the posterior of the tongue, the tongue being provided with a top surface and a bottom surface, the bottom surface approximate the flange;

a plurality of first terminals supported by the housing, each of the first terminals being provided with an elastic contact exposed on the top surface of the tongue;

a plurality of second terminals fixedly supported by the housing, each of the second terminals being provided with a second contact exposed on the top surface of the tongue and being in closer proximity to the front end of the tongue than the elastic contacts of the first terminals;

a plurality of third terminals supported by the housing, each of the third terminals being provided with a third contact exposed on the bottom surface of the tongue; and a shield fitted over the exterior of the housing; wherein a posterior of each of the third contacts is wedged between the bottom surface of the tongue and the flange.

2. The electrical connector as recited in claim 1, wherein the tongue is further provided with two protruding ribs positioned respectively on the left and right sides, and the flange is fitted with two clip grooves that receive the corresponding protruding ribs.

3. The electrical connector as recited in claim 2, wherein the flange is a U-shaped flange, the U-shaped flange being fitted over the bottom surface and both sides of the tongue posterior.

4. The electrical connector as recited in claim 3, wherein the tongue is further provided with a plurality of third terminal slots fitted on the bottom surface and respectively receiving the third contacts, and wherein the flange is fitted with a plurality of third terminal passageways respectively corresponding to each of the third terminal slots.

5. The electrical connector as recited in claim 4, wherein each of the third terminals are further provided with a third fixed part, extending toward the rear from the third contact and fixed into the corresponding third terminal slot and third terminal passageway, and a third connection-guiding part extending in an inverted U curve from the third fixed part.

6. The electrical connector as recited in claim 5, wherein each of the first terminals are further provided with a first fixed part, extending back from the elastic contact and fixed to the corresponding first terminal passageway, and a first connection-guiding part extending downward from the first fixed part.

7. The electrical connector as recited in claim 3, wherein the tongue is further provided with a plurality of first terminal slots which are depressed at intervals downward from the top surface, wherein the rear ends of the first terminal slots are defined by a boss part, and each of the first terminal slots respectively receive the elastic contacts of the first terminals; the base further possesses a plurality of first terminal passageways fitted on the base wall and corresponding to the first terminal slots, and each location where the first terminal passageways correspond to the boss parts is provided with a yield notch.

8. The electrical connector as recited in claim 3, wherein the posterior of the top surface of tongue as well as locations in the base wall of the base positioned within the assembly slot are provided with a plurality of clip slots and clip blocks which are mated to one another.

9. The electrical connector recited in claim 3, wherein the second terminals are insert-molded into the tongue, and are further provided with a second connection-guiding part that extends convexly out from the tongue and extends downward.

10. The electrical connector as recited in claim 3, wherein the electrical connector is installed onto a circuit board provided with a notch, and the electrical connector is partially positioned beneath the board by means of the notch; the base is further provided with two side walls which are respectively connected to the two forward extensions of the base wall and positioned on both the left and right sides of the tongue, and two rear cantilevers which are respectively connected to both sides of the base wall and extend opposite to the upper portion of each side wall toward the rear, such that the bottom of the two rear cantilevers prop up the surface of the circuit board.

11. The electrical connector as recited in claim 3, wherein the first terminals are a group of terminals for transmitting signals that conform to the USB 2.0 signal transmission standard; the first terminals act with the second terminals as a group of terminals for transmitting signals that conform to the USB 3.0 signal transmission standard; and the third terminals are a group of terminals for transmitting signals that conform to the ESATA signal transmission standard.

* * * * *